US006094892A

United States Patent [19]

Lees

[11] Patent Number: 6,094,892

[45] Date of Patent: Aug. 1, 2000

[54] VERTICAL SEALING ASSEMBLY FOR A PACKAGING MACHINE

[75] Inventor: John Lees, Minneapolis, Minn.

[73] Assignee: Tetra Laval Holdings & Finance, SA, Pully, Switzerland

[21] Appl. No.: 09/141,696

[22] Filed: Aug. 28, 1998

[51] Int. Cl.[7] ..... B65B 7/16

[52] U.S. Cl. ..... 53/467; 53/284.5; 53/477; 53/484; 53/371.6; 53/374.6; 53/376.7; 53/377.8

[58] Field of Search ..... 493/165, 184; 53/268, 565, 270, 271, 284, 5, 467, 468, 477, 484, 491, 370.6, 371.3, 371.5, 371.6, 371.8, 371.9, 374.5, 374, 6, 374.9, 375.9, 376.2, 376.6, 376.7, 376.8, 377.7, 377.8

[56] References Cited

U.S. PATENT DOCUMENTS

| | | | |
|---|---|---|---|
| 3,280,535 | 10/1966 | Reimers et al. | 53/371.8 |
| 3,319,398 | 5/1967 | Vadas et al. | 53/371.9 X |
| 3,579,958 | 5/1971 | Hentges et al. | 53/371.9 X |
| 3,613,331 | 10/1971 | Garrett | 53/284.5 |
| 3,699,743 | 10/1972 | King et al. | 53/371.9 X |
| 3,820,303 | 6/1974 | Martensson et al. | 53/370.9 X |
| 3,890,765 | 6/1975 | Farfaglia et al. | 53/284.5 X |
| 3,918,236 | 11/1975 | Allen | 53/284.5 X |
| 4,375,145 | 3/1983 | Mosse et al. . | |
| 4,580,392 | 4/1986 | Lagerstedt et al. | 53/552 X |
| 4,992,247 | 2/1991 | Foti . | |
| 5,488,812 | 2/1996 | Stark et al. | 53/565 X |
| 5,588,279 | 12/1996 | Runnberg et al. | 53/372.4 X |
| 5,660,100 | 8/1997 | Spelten . | |
| 5,819,504 | 10/1998 | Giacomelli . | |

*Primary Examiner*—Daniel B. Moon
*Attorney, Agent, or Firm*—Welsh & Katz, Ltd.

[57] ABSTRACT

A sealing mechanism for sealing the open end of a container being processed on a packaging machine. The sealing mechanism includes a first and second jaw assembly positioned on opposite sides of a longitudinal pathway. Each jaw assembly includes a pair of sealing jaws, a plurality of grippers, a platform and a platform guide. The jaw assemblies operate along a continuous loop about the longitudinal pathway removing containers from filling mandrels during filling and sealing the open end thereof of the previously removed container.

15 Claims, 9 Drawing Sheets

VERTICAL SEALING ASSEMBLY FOR A PACKAGING MACHINE

BACKGROUND OF THE INVENTION

1. Field of the Invention

The present invention relates to filling machines. Specifically, the present invention relates to a packaging machine for forming, filling and sealing a carton from a blank.

2. Description of the Related Art

Milk or juice is often packaged in containers that have been sterilized to prolong shelf life of the contents under refrigeration. When milk or juice is being packaged under aseptic packaging conditions, the contents are capable of being stored for a substantial period of time at room temperature without spoilage. Such packaging processes require effective sterilization of the packaging material prior to filling of a container formed from the packaging material. For example, a container, such as a gable-top carton, that has previously been partially formed may have its interior surfaces sterilized prior to being filled with product. U.S. Pat. No. 4,375,145, discloses a packaging machine having a conveyor on which pre-formed cartons advance under ultraviolet germicidal solution, such as hydrogen peroxide, passing under the ultraviolet lamps.

A popular type of packaged product is an Extended Shelf Life ("ESL") packaged product due to the added value such a filled container presents to a retailer. For example, pasteurized milk processed and packaged under typical conditions has a shelf life at four degrees Celsius of seven to fourteen days while the same milk processed and packaged under ESL conditions has a shelf life of fourteen to sixty days. Under ESL conditions, juice may have a shelf life of forty to one-hundred twenty days, liquid eggs sixty to ninety days, and eggnog forty-five to sixty days. Thus, ESL packaging greatly enhances a product since it extends the time period that the particular product may be offered for sale to the consuming public. In order to have ESL filling, the filling system should be kept sterile in order to prevent contamination of the product or container during filling on a form, fill and seal package machine.

Another problem with current sterilization practices is the limitation of concentration of hydrogen peroxide that may be used on packaging material for food. Only a minute quantity of hydrogen peroxide residue may be found on the packaging that limits most applications to less than 1% concentration, and requiring UV light. However, as mentioned above, UV lamps and associated components are very expensive and require more maintenance and energy than machines without UV lamps.

Another popular type of packaged product is an aseptic packaged product due to the tremendous value such a filled container presents to a retailer. For example, ultra high temperature processed milk may have a non-refrigerated shelf life of over one-year in a TETRA BRIK® Aseptic package. Such a package is fabricated from a web of packaging material on a vertical form, fill and seal packaging machine that is substantially enclosed except for an outlet for the final package. It is quite apparent that producing a package capable of non-refrigerated distribution is highly desirable, however, the packaging machine must be substantially enclosed to prevent any and all contamination of the product, the machine or the packaging material.

In the area of aseptic linear form, fill and seal packaging machines, wherein a series of container blanks are utilized instead of a web of packaging material, the maintenance of the entire machine in a non-contaminated enclosed environment is highly critical. One such machine is disclosed in U.S. Pat. No. 5,660,100 wherein a preheating zone, a sterilizing zone, a drying zone, a filling zone and a closure zone are all enclosed within a single sterile space that optimizes hermeticity. A hydrogen peroxide aerosol or liquid is utilized to sterilize the packages and the enclosure. As is apparent, the hermetically sealed environment is the most important factor in maintaining the aseptic environment. Such an environment increases the price of the machine and requires substantial maintenance.

Another machine is disclosed in U.S. Pat. No. 4,992,247 wherein a container sterilization system is adaptable to a form, fill and seal machine. The system is a closed loop system having a chamber, a blower for directing a mixture of air, vaporized hydrogen peroxide and vaporized water through ductwork and to a vapor delivery inlet manifold disposed above a line of conveyors conveyed therethrough the system. An exhaust manifold is positioned below the containers to receive the mixture. An iso-box is positioned at the front of the inlet manifold to serve as an air lock or curtain to prevent outside contaminants from entering the chamber and to prevent vaporized hydrogen peroxide from leaving the chamber. Containers enter the iso-box before entering the chamber. In the chamber, hydrogen peroxide condenses on the inner surfaces of each of the containers prior to exiting through another iso-box. As each container moves through the chamber, liquid hydrogen peroxide condenses on inner surfaces and eventually equilibrium is reached between the liquid and vapor hydrogen peroxide. The pre-heating temperatures and the processing temperatures are controlled to maintain the sterilizing effect. After the iso-box is a drying air inlet manifold having heated air flowing from a HEPA filter. Although U.S. Pat. No. 4,992,247 discloses that the system is positioned between a bottom forming station and a top sealing station, it is assumed that a filling station is disposed adjacent the drying manifold. It is important in U.S. Pat. No. 4,992,247 that the hydrogen peroxide condense on the containers in order to have the desired "scrubbing" effect.

An ESL machine is capable of producing a large number of containers per hour of operation and allows for an "open" operating environment as compared to an aseptic machine that requires a substantially enclosed environment for most of the machine to prevent contamination of the packaging material, product and machinery. However, the aseptic container is capable of non-refrigerated storage for long periods of time. In the sterilized package stage, positioned between ESL packages and aseptic packages, are high acid ambient distribution ("HAAD") packages. The HAAD package is capable of non-refrigerated storage, however, the product must have a minimum acidity (pH less than 4.6) such as the acidity of orange juice (pH 2.8) as compared to the acidity of milk (pH 6.9) which is an unacceptable product for a HAAD package.

Current packaging machines utilized to form, fill and seal a carton to produce either an extended shelf life ("ESL") product or a shelf stable aseptic product, are often very large in that the area (also referred to as the "footprint") occupied is upwards to thirty square meters (usually 10 meters in length by 3 meters in width). The size of these machines present many problems for a dairy or other facility that may have a need for a packaging machine capable of producing aseptic or ESL products. The most obvious is the size, in that some dairies are just too small to accommodate such a machine. Next, a larger machine requires a greater amount of chemicals and other supplies to disinfect the machine after every production cycle. Further, a greater amount of labor is required too not only disinfect but maintain the machine in an operational manner.

Another problem with current packaging machines is the inability to sterilize an entire carton since in a typical packaging machine the bottom is formed and sealed prior to sterilization.

BRIEF SUMMARY OF THE INVENTION

One aspect of the present invention is a method for sealing an open end of a container being processed on a packaging machine. The first step is rotating a first filling mandrel with a first container attached thereon to a longitudinal pathway. The next step is gripping the first container with a first plurality grippers attached to a first sealing jaw assembly. Next, the container is filled with a product through a filling tube disposed within the first filling mandrel as the container is lowered from the first filling mandrel by the first plurality of grippers. Next, a second filling mandrel with a second container thereon is rotated to the longitudinal pathway. This second container is gripped with a second plurality grippers attached to a second sealing jaw assembly while simultaneously closing a pair of sealing jaws of the second jaw assembly about the open end panels of the first container. Next, the open end panels of the first container are sealed and the container is lowered to a conveyor at an end of the longitudinal pathway.

Another aspect of the present invention is a sealing mechanism having a first jaw assembly and a second jaw assembly. The first jaw assembly has a first platform connected to a first platform guide that extends along a longitudinal pathway. The first jaw assembly also has a first pair of sealing jaws and a first plurality of carton grippers. The second jaw assembly has a second platform connected to a second platform guide that extends along the longitudinal pathway. The second platform has a second pair of sealing jaws and a second plurality of carton grippers. The second jaw assembly is disposed on a side of the longitudinal pathway opposite the first jaw assembly.

Yet another aspect of the present invention is a packaging having the aforementioned sealing mechanism integrated thereon. The packaging machine also has a plurality of filling mandrels connect to a carousel.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which.

DETAILED DESCRIPTION OF THE INVENTION

Figure 1:
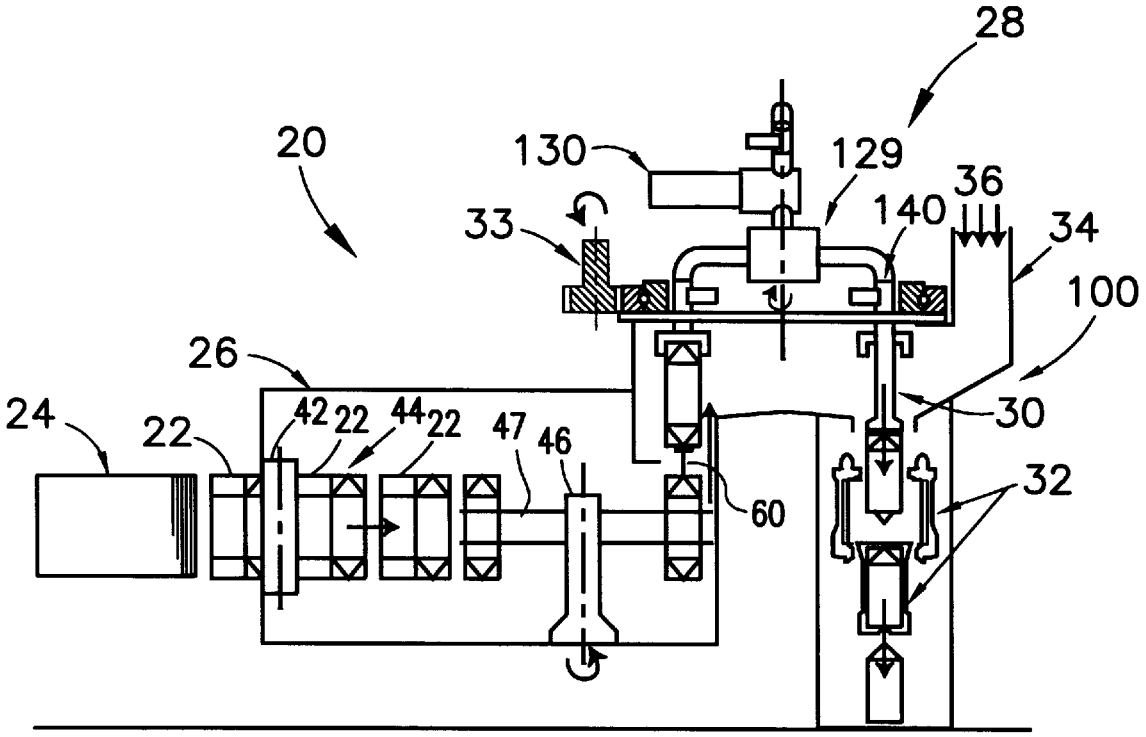
FIG. 1 is a schematic view of a preferred embodiment of the packaging machine of the present invention.

As shown in FIG. 1, a packaging machine is generally designated 20. The packaging machine 20 is provided with a series of carton blanks 22 from a magazine 24. The packaging machine 20 generally includes an infeed sterilizer 26, a form and fill carousel 28 with a plurality of filling mandrels 30 thereon, and a top sealing mechanism 32. The forming, filling and sealing operations are all performed within a sterile barrier 34 that is pressurized by a supply of sterile air 36 flowing therein. The sterile barrier forms an enclosed environment about the components of the packaging machine 20. A more detailed explanation of the packaging machine is provided in co-pending U.S. patent application Ser. No. 09/141,695, filed on an even date herewith the filing of the present application, entitled Filling Machine, and which is hereby incorporated by reference in its entirety.

Figure 2:
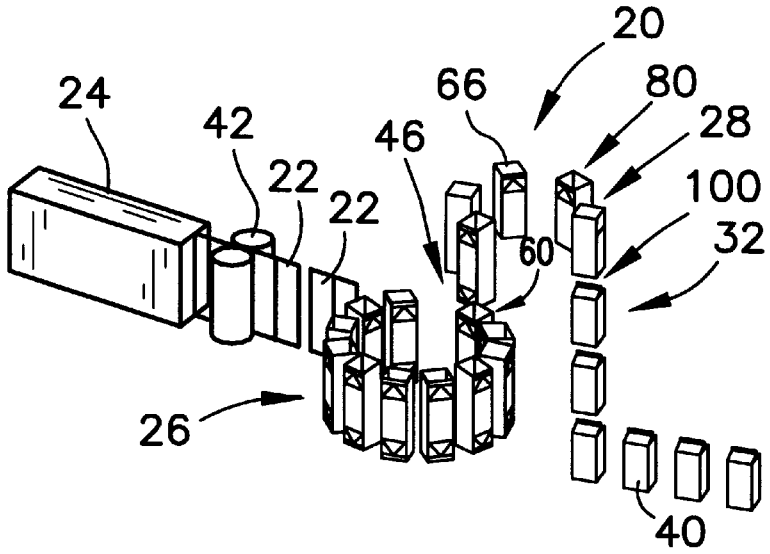
FIG. 2 a schematic top view of the progression of cartons on the packaging machine of FIG. 1.
Figure 3:
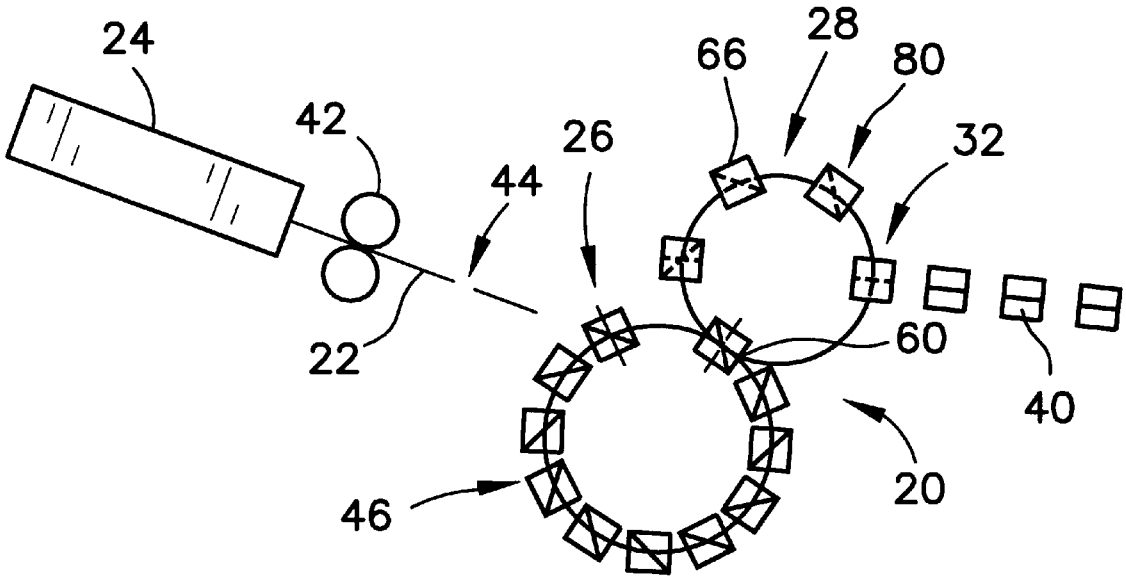
FIG. 3 is a schematic top plan view of FIG. 2.

The progression of carton blanks 22 to finished cartons 40 is shown in FIGS. 1–3, however, FIG. 2 provides an isolated view of the fabrication of the cartons 40 on the packaging machine 20. A nip roller 42 draws in the blanks 22 to the infeed sterilizer 26. The nip roller 42 overbreaks the blanks 22 reducing the blanks 22 memory/tendency to revert to a diamond shape. The exterior of the flat blanks 22 may be sterilized at an infeed conveyor 44 before being transferred to a sterilization carousel 46. Upon egress from the infeed conveyor 44, the flat carton blanks 22 are erected to a partially formed carton 40 and positioned within guides 47 on the sterilization carousel 46. The interior, as well as the exterior, of the cartons 40 may be sterilized during rotation on the sterilization carousel 46. A sterilant, such as gas-phase hydrogen peroxide may be flowed onto the carton while the cartons 40 are rotated on the sterilization carousel 46. A further explanation of the infeed sterilization is provided in co-pending U.S. patent application Ser. No. 09/141,716, filed on the same date of the present Application, entitled Infeed Sterilizer For A Packaging Machine, and hereby incorporated by reference. The infeed sterilizer 26 sterilizes each carton 40 in preparation of further forming and filling on the machine 20 which is performed on the carousel 28.

Figure 4:
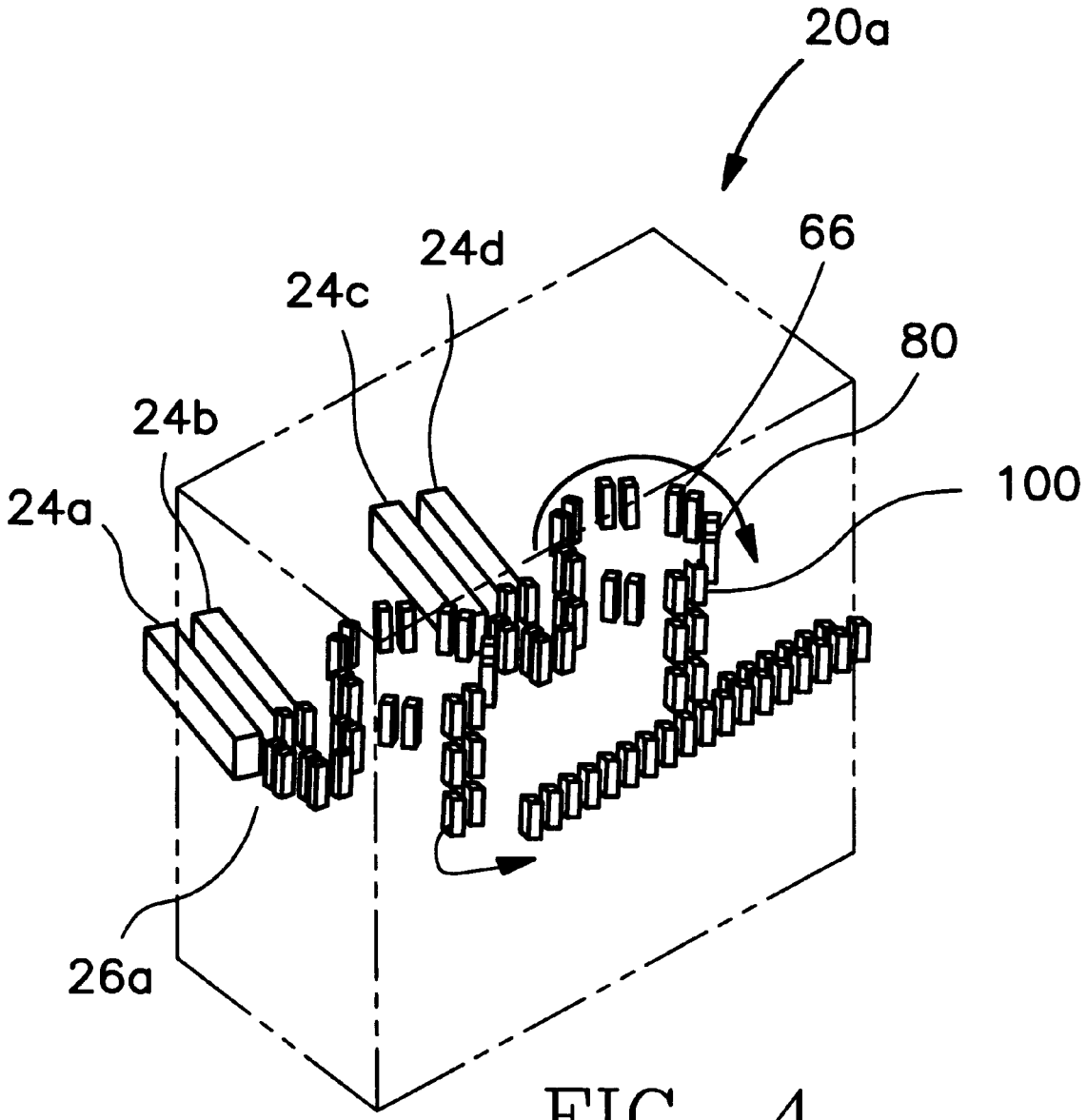
FIG. 4 is a schematic view of an alternative embodiment of the packaging machine of the present invention.
Figure 5:
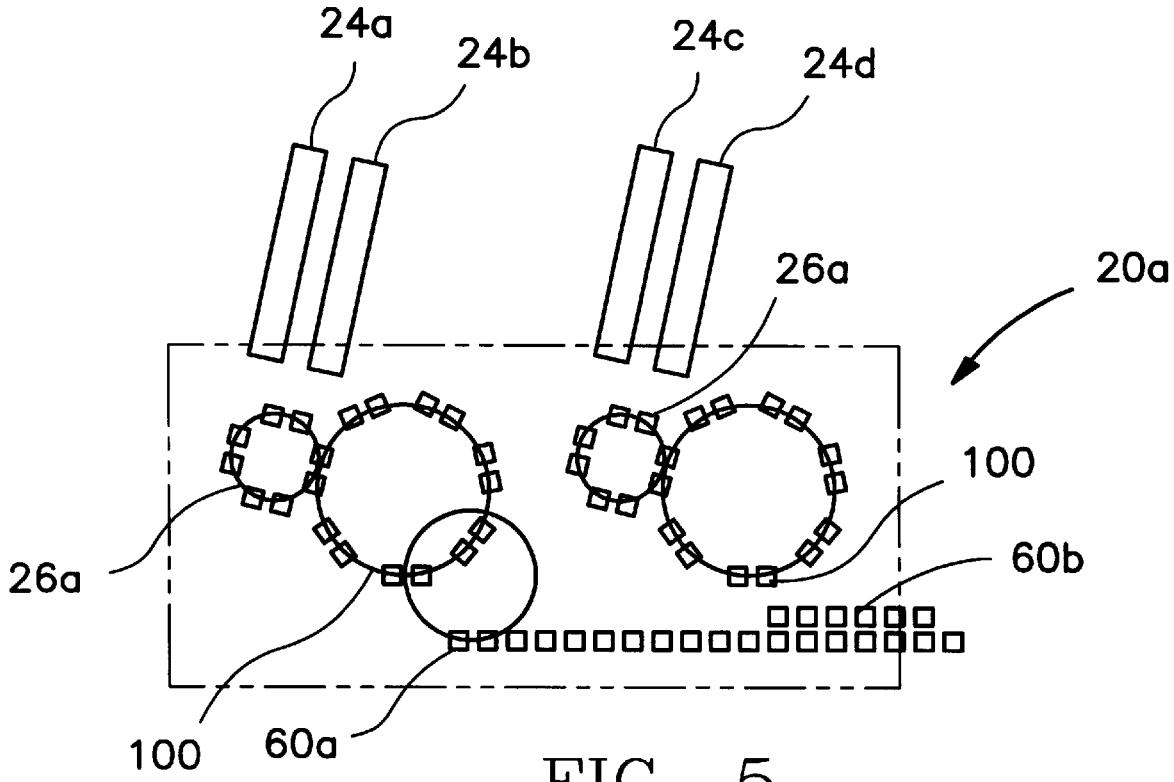
FIG. 5 is a schematic top plan view of FIG. 4.
Figure 6:
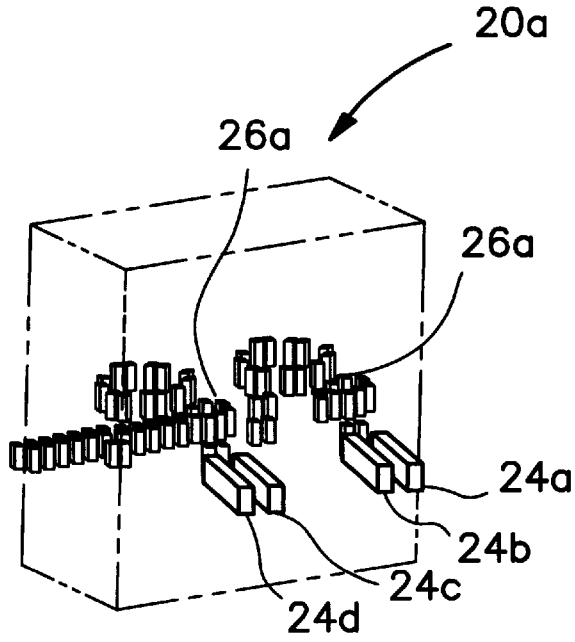
FIG. 6 a schematic top view of the progression of cartons on the packaging machine of FIG. 4.

An alternative embodiment of the machine 20*a* is illustrated in FIGS. 4–6. This variant is for a high-hygiene, high capacity, mini cross-section (the cross-section of the carton) filling machine. The infeed sterilizer 26 of FIG. 1 is replaced by a small carousel 26*a* for pre-folding of the top panels of the cartons 40 and also for application of a fitment to the carton. One possible fitment application machine is disclosed in U.S. Pat. No. 5,819,504, entitled Process And Apparatus For Applying Fitments To A Carton, which is hereby incorporated by reference.

The machine 20*a* of FIGS. 4–6 has two lines 60*a–b* that are fed by a plurality of magazines 24*a–d*. Each of the lines 60*a–b* simultaneously process two cartons 40 for increased production. After the small carousel, the machine 20*a* is substantially similar to the machine 20 of FIG. 1 except that two cartons 40 are processed simultaneously instead of one carton 40.

A carton lifter 60 transfers the sterilized carton blank 22 to the form and fill carousel 28. The lifter 60 places the carton 40 on a filling mandrel 30 for processing on the carousel 28. After each carton 40 is lifted onto the carousel 28, the carton 40, attached to a mandrel 30, is rotated about a central turret 129 to various stations for bottom forming and eventually filling. The carousel is driven by a drive pinion mechanism 33. The bottom panels 62 are heated and the top panels of each carton 40 may also be heated. A preferred heating method is to flow hot air onto the panels through a hot air blower, not shown. The hot air heats the thermoplastic coating of the carton to its melting temperature allowing for eventual chemical bonding for sealing purposes. Next, the carton bottom is folded at a folding station 66. At first arm mechanism "breaks" the score lines by exerting a force on the sides of the bottom panels of the carton 40. Next, a folding plate arm folds the bottom panels inward about the "cap" area of the filling mandrel 30. Next, the carton 40 is rotated to a bottom sealing station 80, where a sealing plate presses against the bottom panels and the cap area of the filling mandrel 30 thereby heat sealing the bottom panels together by welding of the thermoplastic coatings. The sealing plate also acts to cool the bottom panels lowering the temperature of the thermoplastic coating to below its melting temperature. A preferred thermoplastic coating is polyethylene. Once the carton bottom is formed and sealed, the carton 40 is ready for filling.

At a filling and top sealing station 100 the carton is filled with a desired product such as milk or juice, as it is pulled off of the filling mandrel 30. The flow of product to the fill tube of the filling mandrel 30 is controlled by a metering pump 130 mounted on the turret 129 of the form and fill carousel 28. The metering pump 130 ensures that the proper amount of product is provided for each carton through the fill tube of the filling mandrel 30.

During the filling procedure, a carton 40 that has been previously bottom formed on the mandrel 30 is rotated to a filling position and lowered along a longitudinal pathway. At the end of the downward movement, the open end, and more likely than not the top end, is sealed together to form a finished product. The top sealing is accomplished by the top sealing mechanism 32 which will be described in more detail below.

Figure 7:
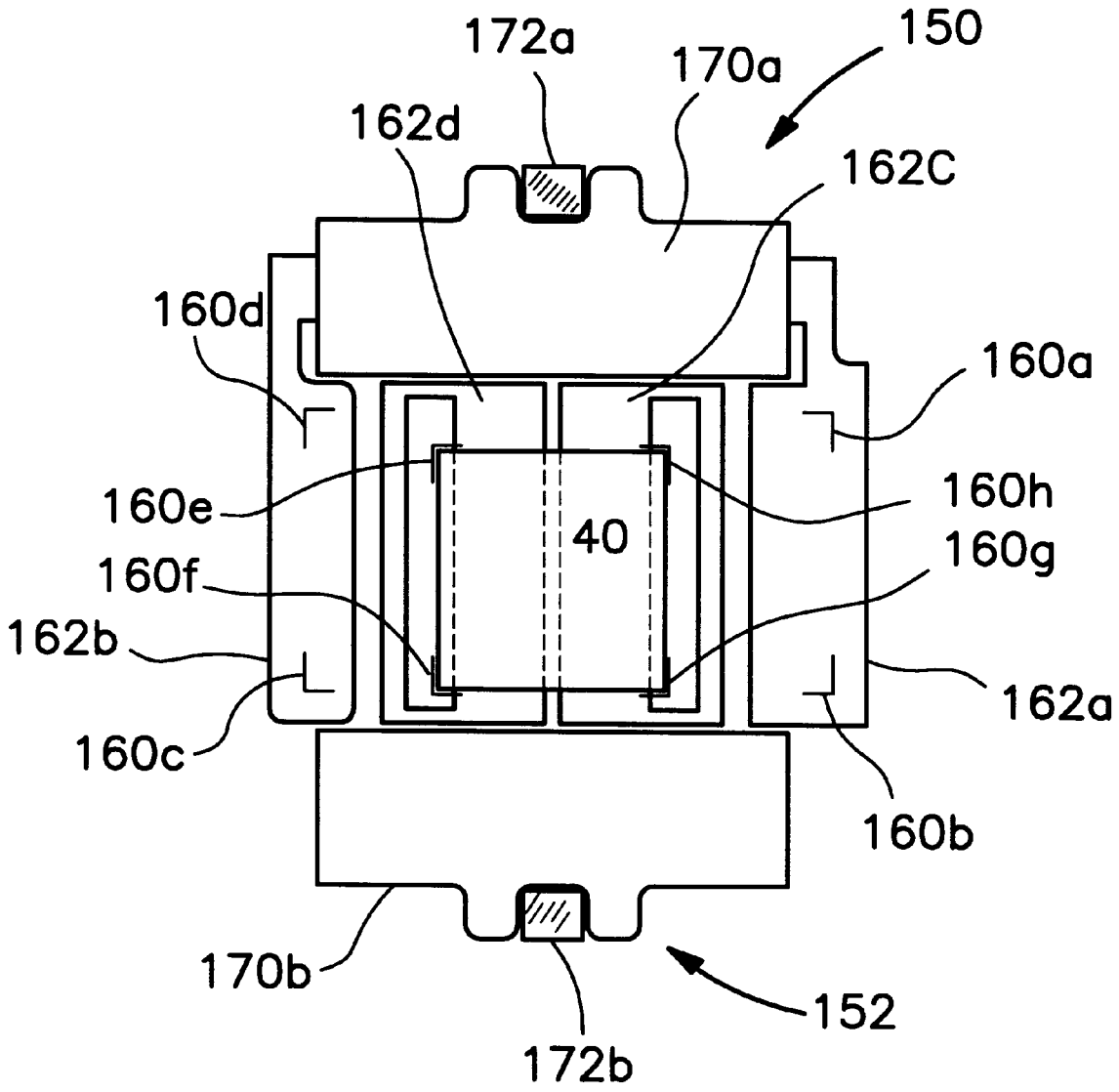
FIG. 7 is an isolated top plan view of a carton engaged in the top sealing mechanism of the present invention.

As shown in FIG. 7, the top sealing mechanism 32 includes a first jaw assembly 150 and a second jaw assembly 152 which operate in harmony to grasp cartons 40 and seal the open end of the cartons 40. The first jaw assembly 150 includes a pair of sealing jaws 160*a–d*, a plurality of carton grippers 162*a–d*, a platform 170*a* and a platform guide 172*a*. The second jaw assembly 152 includes a pair of sealing jaws 162*c–d*, a plurality of carton grippers 160*e–h*, a platform 170*b* and a platform guide 172*b*. The jaw assemblies 150 and 152 are disposed opposite each other about the longitudinal carton pathway. The jaw assemblies operate 150 and 152 operate to pull off cartons 40 off the filling mandrels 30 during the filling operation, and then to seal the open end, usually the top end, of the cartons 40. As explained in reference to FIGS. 7A–7F, one jaw assembly pulls a carton 40 off a filling mandrel 30 and then the other jaw assembly seals the open end of the carton 40. Then, the jaw assembly that pulled the carton off the filling mandrel 30 opens translationally to the longitudinal pathway and travels upward past the other sealing jaw assembly to pull off a subsequent carton 40 from a subsequent filling mandrel 30. After the first carton is pulled off of the first filling mandrel 30, the filling mandrel is rotated away from the longitudinal pathway and a subsequent filling mandrel is rotated into its place. Substantially simultaneous with the rotation of the subsequent filling mandrel 30, the first jaw assembly travels upward.

Figure 7A:
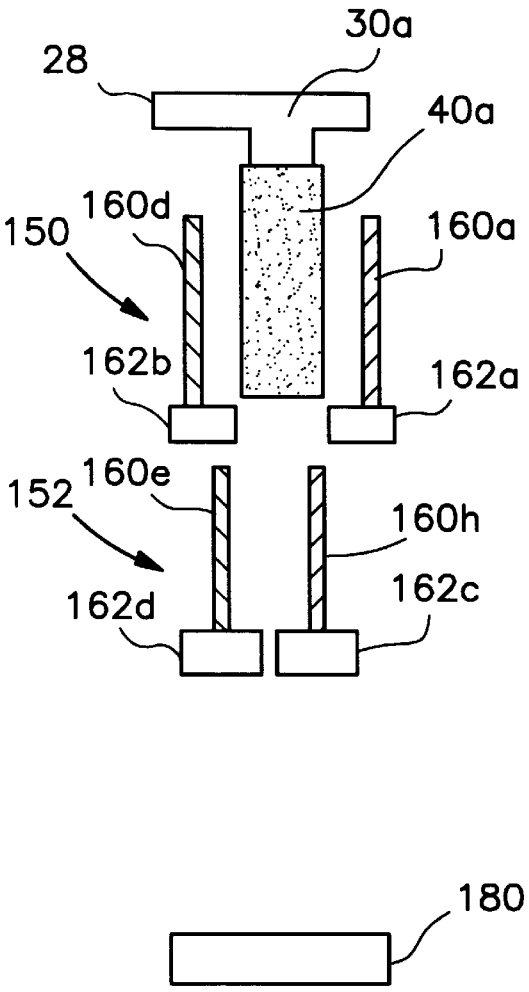
FIG. 7A is an isolated schematic view of the top sealing mechanism of the present invention at one point in time.

Referring now specifically to FIG. 7A, a carton 40*a* is positioned over the longitudinal pathway by the filling mandrel 30*a* that is connected to the carousel 28. The first jaw assembly 150 has traveled upward and is in position to engage the carton 40*a*. The second sealing jaw assembly 152 is shown without a carton to provide clarity with the top sealing and filling operation. As shown in FIG. 7A, the sealing jaws 162*a–b* are in an open position are below the carton 40*a*. The sealing jaws 162*c–d* of the second sealing jaw assembly 152 are in the closed position.

Figure 7B:
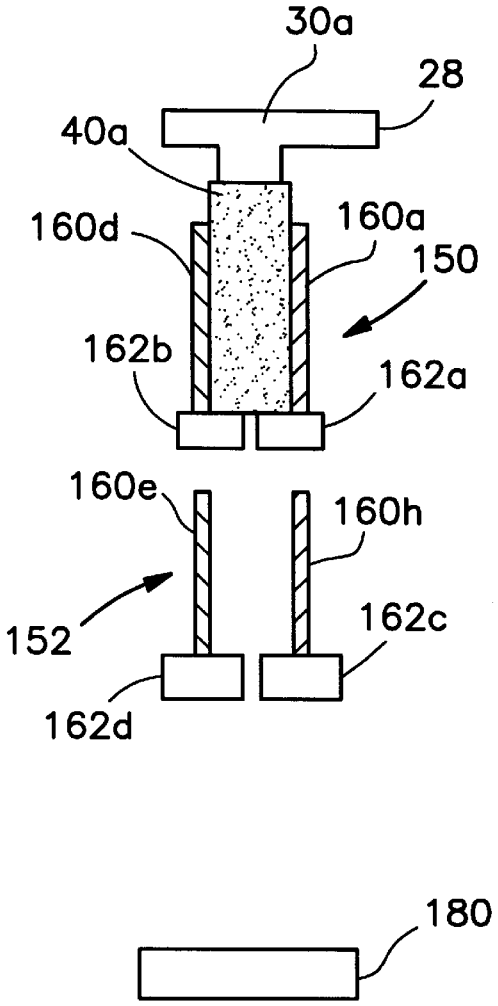
FIG. 7B is an isolated schematic view of the top sealing mechanism of the present invention at a second point in time.

Referring to FIG. 7B, the sealing jaws 162*a–b* have engaged each other, and carton grippers 160*a–d* have engaged the sides of the carton 40*a*. The sealing jaw assembly 150 will begin its descent along the longitudinal pathway as will the second sealing jaw assembly 152. As the first sealing jaw assembly descends with the carton 40*a* attached thereto, the carton will undergo bottom-up-filling to prevent foaming and sloshing that may interfere, by wetting the sealing region, with the sealing of the open end of the carton 40*a*. The first sealing jaw assembly will pull the carton 40*a* entirely off of the filling mandrel 30*a*. Once this is accomplished, the filling mandrel 30*a* will rotate out of the position on the longitudinal pathway.

Figure 7C:
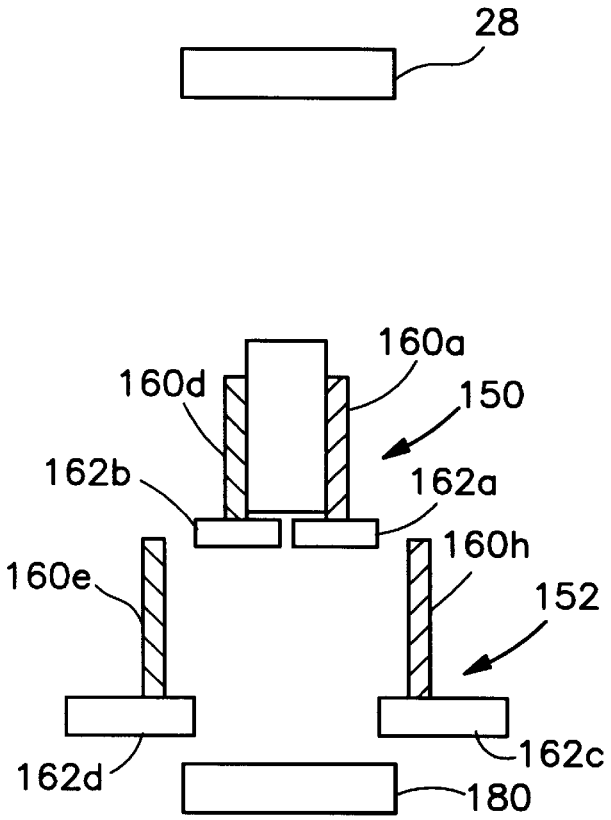
FIG. 7C is an isolated schematic view of the top sealing mechanism of the present invention at a third point in time.

In FIG. 7C, the filling mandrel 30*a* has rotated away from the longitudinal pathway and the sealing jaws 162*c–d* of the second sealing jaw assembly 152 have moved translationally to the longitudinal pathway to the open ascending position. The sealing jaws 162*c–d* with the carton grippers 160*e–h* thereabout will ascend on the outside of the longitudinal pathway so as to not interfere with the first sealing jaw assembly 150 and the carton 40*a* thereon.

Figure 7D:
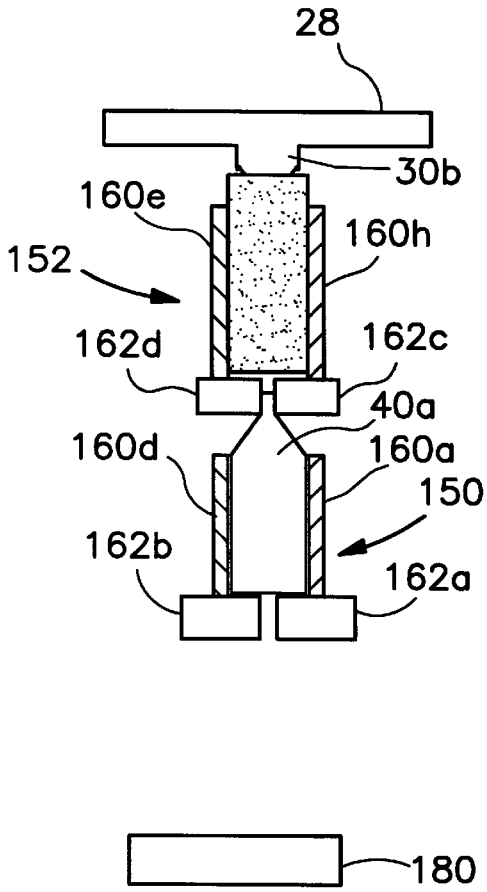
FIG. 7D is an isolated schematic view of the top sealing mechanism of the present invention at a fourth point in time.

In FIG. 7D, a subsequent filling mandrel 30*b* has positioned a subsequent carton 40*b* over the longitudinal pathway. The second sealing jaw assembly 152 has engaged the carton 40*b* with its carton grippers 160*e–h*. The sealing jaws 162*c–d* have folded the open end panels of the carton 40*a* and are engaged for sealing of the open end, usually by sealing the top fin panels of the carton 40*a*. The carton 40*a* has remained stationary until the open end is folded closed in order to prevent wetting of the sealing regions of the carton 40*a* during the next descent.

Figure 7E:
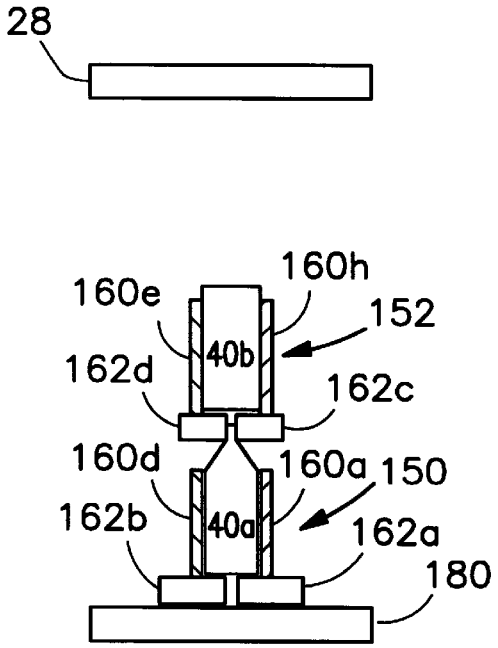
FIG. 7E is an isolated schematic view of the top sealing mechanism of the present invention at a fifth point in time.
Figure 7F:
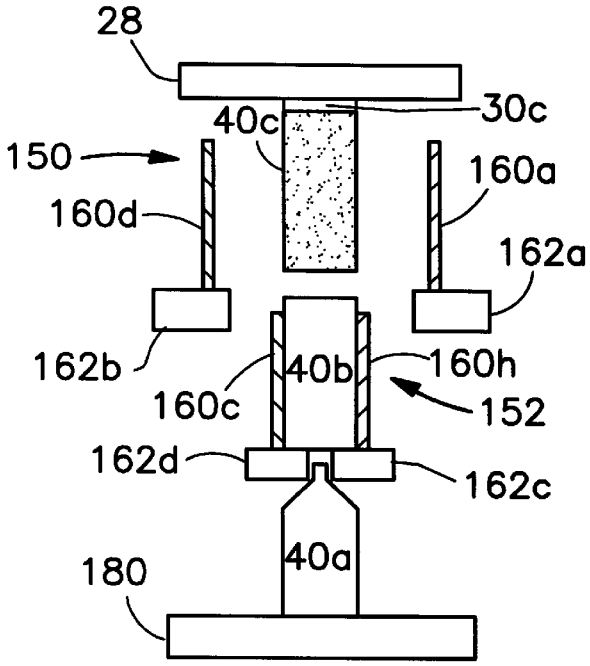
FIG. 7F is an isolated schematic view of the top sealing mechanism of the present invention at a sixth point in time.

At FIG. 7E, both sealing jaw assemblies 150 and 152 have descended along the longitudinal pathway toward a conveyor 180. The carton 40*b* has undergone bottom-up-filling while the carton 40*a* has had its open end sealed. At FIG. 7F, carton 40*a* is resting on the conveyor 180 awaiting the opening of the sealing jaws 162*c–d* of the second sealing jaw assembly 152 while the first sealing jaw assembly 150 has ascended towards a second subsequent carton 40*c* on a filling mandrel 30*c* in order to repeat the process.

Figure 8:
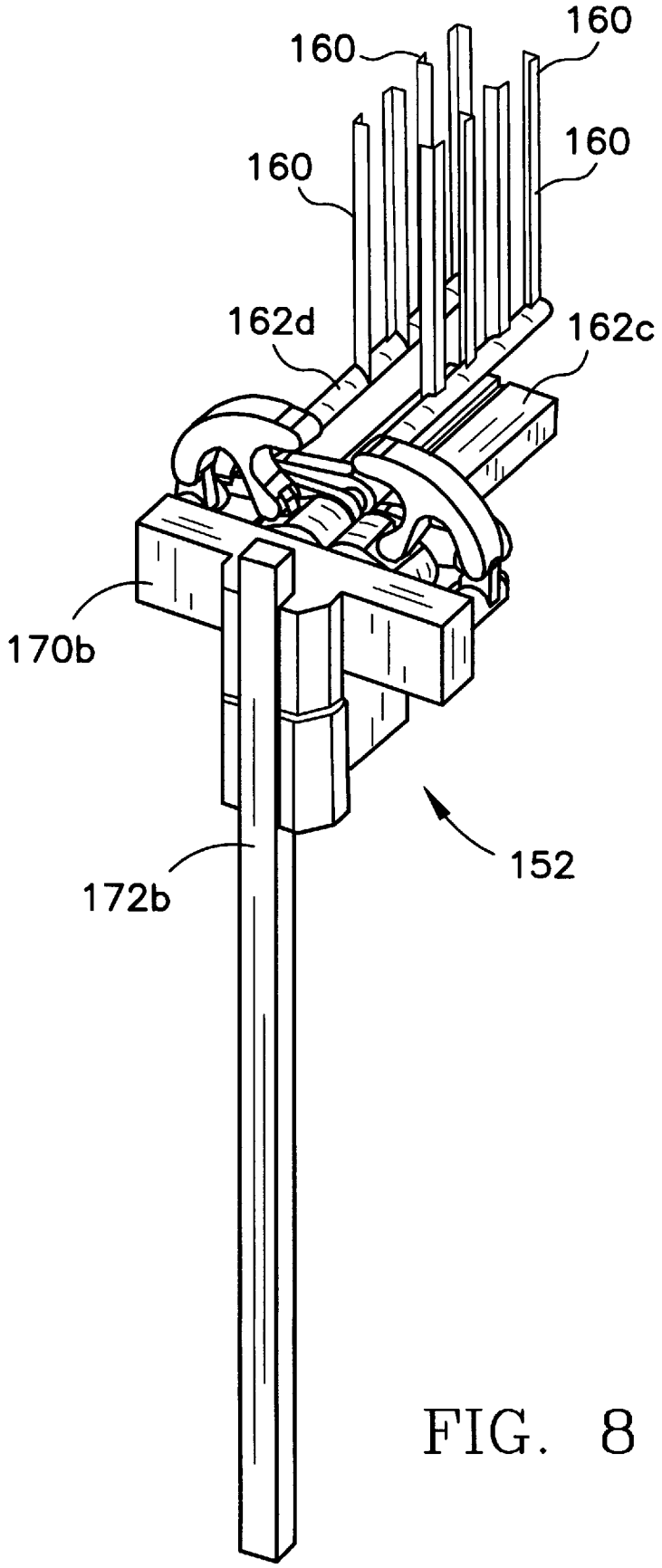
FIG. 8 is an isolated top perspective view of a slight variation of a jaw assembly of the top sealing mechanism of the present invention.

FIG. 8 shows an alternative embodiment of the sealing jaw assembly 152 wherein the assembly 152 is capable of processing two cartons simultaneously for greater production rates.

During the filling and sealing operations, sterile air is flowed downward from the sterile air supply 36 to exclude microorganisms from contaminating the cartons 40. A description of a possible sterile air supply system is disclosed in U.S. Pat. No. 5,979,514, entitled Hygienic Fill System For A Packaging Machine which pertinent parts are hereby incorporated by reference.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A sealing mechanism for a sealing an open end of a container being processed on a packaging machine, the container defined by a plurality of side panels and open end panels, the sealing mechanism comprising:

a first jaw assembly having a first platform connected to a first platform guide that extends along a longitudinal pathway, the first platform having a first pair of sealing jaws and a first plurality of carton grippers;

a second jaw assembly having a second platform connected to a second platform guide that extends along the longitudinal pathway, the second platform having a second pair of sealing jaws and a second plurality of carton grippers, the second jaw assembly disposed on a side of the longitudinal pathway opposite the first jaw assembly, wherein the first and second jaw assemblies cooperate with one another so that as the first jaw assembly grasps a first carton, the second jaw assembly grasps a second carton and positions the second carton so that the first jaw assembly seals the open top panels of the second carton.

2. The sealing mechanism according to claim 1, wherein the first plurality of carton grippers grasp a first carton and the second plurality of carton grippers grasp a second carton and wherein the sealing jaws of the first jaw assembly seal the open end panels of the second carton.

3. The sealing mechanism according to claim 1 wherein the first jaw assembly and the second jaw assembly cooperate with one another for sealing the open end panels of two containers simultaneously.

4. The sealing mechanism in accordance with claim 1, wherein the longitudinal pathway for the first and second jaw assemblies is a generally vertical pathway, and wherein the jaw assemblies move in an upward and downward manner through the vertical pathway, wherein in the downward manner the carton grippers are spaced from one another to grasp a carton and the sealing jaws are spaced from one another to seal the open top panels of a next lower carton and when in the upward manner, the carton grippers are spaced a greater distance than in the downward manner to pass over a next upper carton.

5. The sealing mechanism in accordance with claim 4 wherein the generally vertical pathway traversed by each of the jaw assemblies through the upward and downward manners of movement defines a continuous loop pathway.

6. A packaging machine for processing a series of containers, the containers defined by a plurality of side panels and open top panels, the packaging machine comprising:

a plurality of filling mandrels, each comprising a body having a first end and a second end, the second end defining a cap area having an outlet, a first jaw assembly having a first platform connected to a first platform guide that extends along a longitudinal pathway, the first platform having a first pair of sealing jaws and a first plurality of carton grippers; and a second jaw assembly having a second platform connected to a second platform guide that extends along the longitudinal pathway, the second platform having a second pair of sealing jaws and a second plurality of carton grippers, the second jaw assembly disposed on a side of the longitudinal pathway opposite the first jaw assembly, wherein the first and second jaw assemblies cooperate with one another so that as the first jaw assembly grasps a first carton, the second jaw assembly grasps a second carton and positions the second carton so that the first jaw assembly seals the open top panels of the second carton.

7. The packaging machine according to claim 6 wherein each of the plurality filling mandrels is connected to a rotating carousel that positions a filling mandrel along the longitudinal pathway for filling a container attached to the filling mandrel and wherein the carton being filled is removed by one of the plurality of carton grippers.

8. The packaging machine according to claim 6 further comprising a conveyor mechanism positioned at a lower end of the longitudinal pathway.

9. The packaging machine according to claim 6 wherein a container attached to a filling mandrel positioned over the longitudinal pathway is filled with a product as it is removed from the filling mandrel by one of the plurality carton grippers.

10. The packaging machine in accordance with claim 6 wherein the longitudinal pathway for the first and second jaw assemblies is a generally vertical pathway, and wherein the jaw assemblies move in an upward and downward manner through the vertical pathway, wherein in the downward manner the carton grippers are spaced from one another to grasp a carton and the sealing jaws are spaced from one another to seal the open top panels of a next lower carton and when in the upward manner, the carton grippers are spaced a greater distance than in the downward manner to pass over a next upper carton.

11. The packaging machine in accordance with claim 10 wherein the generally vertical pathway traversed by each of the jaw assemblies through the upward and downward manners of movement defines a continuous loop pathway.

12. A method for sealing an open end of a container being processed on a packaging machine, the container defined by a plurality of side panels and open top panels, the method comprising:

rotating a first filling mandrel with a first container attached thereon to a longitudinal pathway;

gripping the first container with a first plurality of grippers attached to a first sealing jaw assembly;

filling the first container with a product through a filling tube disposed within the first filling mandrel as the container is lowered from the first filling mandrel by the first plurality of grippers;

rotating a second filling mandrel with a second container thereon to the longitudinal pathway;

gripping the second container with a second plurality of grippers attached to a second sealing jaw assembly while simultaneously closing a pair of sealing jaws of the second jaw assembly about the open end panels of the first container as the first container is gripped by the first plurality of grippers;

sealing the open end panels of the first container by engagement of the second sealing jaw with the open end panels of the first container; and lowering the sealed first container to a conveyor at an end of the longitudinal pathway.

13. The method according to claim 12 further comprising opening the grippers of the first jaw assembly and raising the first jaw assembly to a top end of the longitudinal pathway to engage a third container attached to a third filling mandrel.

14. The method according to claim 12 wherein the first jaw assembly comprises a first platform connected to a first platform guide that extends along the longitudinal pathway, the first platform having a first pair of sealing jaws and a first plurality of carton grippers, and the second jaw assembly comprises a second platform connected to a second platform guide that extends along the longitudinal pathway, the second platform having a second pair of sealing jaws and a second plurality of carton grippers, the second jaw assembly disposed on a side of the longitudinal pathway opposite the first jaw assembly.

15. The method according to claim 12 further comprising sterilizing the container and sealing one end of each of the containers prior to rotating the first filling mandrel to the longitudinal pathway.

* * * * *